United States Patent [19]

Hicks et al.

[11] Patent Number: 4,945,822

[45] Date of Patent: Aug. 7, 1990

[54] AIR CONTROL APPARATUS FOR FORCED AIR CENTRAL AIR CONDITIONING SYSTEMS

[76] Inventors: Lester R. Hicks; E. LaRuth Hicks, both of Rte. 2, Fort Cobb, Okla. 73038

[21] Appl. No.: 332,872

[22] Filed: Apr. 3, 1989

[51] Int. Cl.[5] ..... F24F 7/06

[52] U.S. Cl. ..... 98/41.3; 251/327; 251/329; 251/291; 98/39.1

[58] Field of Search ..... 98/31.6, 39.1, 41.3; 237/46; 251/291, 326, 327, 328, 329

[56] References Cited

U.S. PATENT DOCUMENTS

| | | | |
|---|---|---|---|
| 521,106 | 6/1894 | Doble | 251/326 X |
| 890,048 | 6/1908 | Groce | 251/326 |
| 974,752 | 11/1910 | McCorquodale | 251/291 X |
| 1,013,075 | 12/1911 | Scott . | |
| 1,206,469 | 11/1916 | Rockwell | 251/326 X |
| 1,211,371 | 1/1917 | Rockwell | 251/326 |
| 1,248,172 | 11/1917 | Schuhmann | 251/291 X |
| 1,488,229 | 3/1924 | Burns | 251/326 X |
| 1,533,137 | 4/1925 | Pospisil . | |
| 2,002,965 | 5/1935 | Smith | 251/327 X |
| 2,226,313 | 12/1940 | Little | 251/291 X |
| 2,349,368 | 5/1944 | Myers | 160/85 |
| 2,449,145 | 9/1948 | Rosmait | 251/327 |
| 2,569,910 | 10/1951 | Venuti | 98/31.6 X |
| 2,596,532 | 5/1932 | Coolidge et al. | 251/291 X |
| 2,804,816 | 9/1957 | Hoyer | 98/31.6 |
| 3,049,146 | 8/1962 | Hayes | 137/517 |
| 3,381,706 | 5/1968 | Hendey | 137/423 |
| 3,773,077 | 11/1973 | Barnebey | 137/625.28 |
| 3,945,606 | 3/1976 | McDonald | 251/326 |
| 4,084,617 | 4/1978 | Happe | 137/625.28 |
| 4,600,144 | 7/1986 | Zelczer | 236/46 R |
| 4,628,954 | 12/1986 | Dayus | 251/291 X |

*Primary Examiner*—Harold Joyce

*Attorney, Agent, or Firm*—Laney, Dougherty, Hessin & Beavers

[57] ABSTRACT

An air control apparatus for a forced air central air conditioning system of the type having an air conditioning unit for conditioning air and a duct for conducting the conditioned air from the unit to a living area of a building. The air control apparatus includes a frame having a border and an air passage defined by the border, the border having a first surface for attachment to a first portion of the duct and an opposite second surface for attachment to a second portion of the duct, and an air seal slidably disposed in the frame between the first and second surfaces of the border, the air seal being movable in and out of the air passage to open and close the air passage and thereby regulate the flow of air therethrough. A handle is removably attached to the air seal and extends away from the frame for allowing the air passage to be manually opened and closed from within the living area of the building. A forced air central air conditioning system having an air control apparatus for regulating the flow of air through the system is also provided.

24 Claims, 4 Drawing Sheets

AIR CONTROL APPARATUS FOR FORCED AIR CENTRAL AIR CONDITIONING SYSTEMS

BACKGROUND OF THE INVENTION

1. Field of the Invention.

The present invention relates in general to forced air central air conditioning systems, and more particularly, to forced air central air conditioning systems of the type having air control apparatus for regulating the flow of air to various rooms of the house or building being serviced by the system.

2. Description of the Prior Art.

In a forced air central air conditioning system, air is conditioned by a heating or cooling unit and forced through a plurality of ducts into the various living areas of the house or building being serviced by the system. The heating and cooling units are usually disposed in a closet in or adjacent to the house or building with some related equipment such as the heat exchanger being disposed outside of the house or building. The ducts typically extend from the heating and cooling units into an area outside of the living areas such as the attic or crawl space and then directly into the living areas at strategically selected locations. A thermostat automatically operates to turn the heating and cooling units on and off to maintain the air in the house or building at the desired temperature.

Unfortunately, most systems do not allow for separate control of the temperature in each living area. In houses or buildings having one or more living areas that are not in regular use, a great deal of energy is wasted. Although the flow of air to the living areas that are not regularly used can be regulated to some extent by opening and closing the air vents attached to the ends of the ducts, such practice is inconvenient and impractical. It is usually difficult and tedious to open and close all of the individual vents in the living areas not subject to regular use. Even when closed, most vents do not completely block the flow of air therethrough.

As a solution to the problem, various forced air central air conditioning systems and apparatus therefor that allow for separate temperature control of various living areas or zones of living areas have been developed. For example, U.S. Pat. No. 4,600,144 to Zelczer, issued July 15,1986, discloses a zone control apparatus for forced air central heating and/or cooling systems that comprises a plurality of electrically or pneumatically operated flow control devices operatively associated with the air ducts of the system and a cycle controller for regulating the flow control devices to block or restrict the flow of air to the various rooms or zones of rooms with which the devices are associated. Although systems and apparatus of this type are a great improvement, they are not suitable for many systems. In residential houses or small buildings having only a small number of living areas that are not in regular use, the money spent to install complex electrically or pneumatically operated zone control equipment can be far greater than the money that the new equipment will save.

The present invention provides a relatively simple means for allowing separate temperature control of various living areas or zones of living areas of a house or building being serviced by a forced air central air conditioning system.

SUMMARY OF THE INVENTION

In one aspect, the present invention provides an air control apparatus for a forced air central air conditioning system of the type having an air conditioning unit for conditioning air and a duct for conducting the conditioned air from the unit to a living area of a building. The air control apparatus comprises a frame having a border and an air passage defined by the border, the border having a first surface for attachment to a first portion of the duct in a position such that the first portion of the duct is in fluid communication with the air passage and an opposite second surface for attachment to a second portion of the duct in a position such that the second portion of the duct is in fluid communication with the air passage, and an air seal slidably disposed in the frame between the first and second surfaces of the border, the air seal being movable in and out of the air passage to open and close the air passage and thereby regulate the flow of air therethrough. A handle is removably attached to the air seal and extends away from the frame for allowing the air passage to be manually opened and closed from within the living area of the building.

In another aspect, the present invention provides a forced air central air conditioning system for conditioning the air in an enclosed living area of a building. The system comprises an air conditioning unit for conditioning air, a duct for conducting air conditioned by the air conditioning unit to the living area, and an air control apparatus. The duct has a main section extending through an area outside of a living area and a tail section extending from the main section through a partition enclosing the living area into the living area. The air control apparatus is positioned between a first portion of the main section of the duct and a second portion of the main section of the duct and comprises a frame having a border and an air passage defined by the border, the border having a first surface attached to the first portion of the main section of the duct in a position such that the first portion of the main section of the duct is in fluid communication with the air passage and a second surface attached to the second portion of the main section of the duct in a position such that the second portion of the main section of the duct is in fluid communication with the air passage whereby air can flow from the first portion of the main section of the duct through the air passage into the second portion of the main section of the duct, and an air seal slidably disposed in the frame between the first and second surfaces of the border, the air seal being movable in and out of the air passage to open and close the air passage and thereby regulate the flow of air therethrough. A handle is removably attached to the air seal and extends away from the frame through a partition enclosing the living area into the living area for allowing the air passage to be manually opened and closed from within the living area.

It is, therefore, an important object of the present invention to provide an apparatus for improving the efficiency of a forced air central air conditioning system.

It is an object of the present invention to provide an apparatus that allows for individual temperature control of various living areas or zones of living areas of a house or building being serviced by a forced air central air conditioning system.

It is an object of the present invention to provide such an apparatus that can be manually operated from within one of the living areas of the house or building.

It is an object of the present invention is to provide such an apparatus that is inexpensive and that can be easily installed in existing systems or in new installations.

Numerous other objects, features and advantages of the present invention will be readily apparent to those skilled in the art upon a reading of the following detailed description of a preferred embodiment of the invention when taken in conjunction with the accompanying drawings.

DETAILED DESCRIPTION OF THE PREFERRED EMBODIMENTS

In one aspect, the present invention provides an air control apparatus for a forced air central air conditioning system of the type having an air conditioning unit for conditioning air and a duct for conducting the conditioned air from the unit to a living area of a building. In another aspect, the present invention provides a forced air central air conditioning system for conditioning the air in an enclosed living area of a building. As used herein and in the appended claims, "a forced air central air conditioning system" refers to an air conditioning system that includes a heating unit (furnace) and/or cooling unit (air conditioner) and a plurality of ducts through which temperature conditioned air is forced from the heating and/or cooling unit into various living areas of the building being serviced. The term "air conditioning unit" refers to a heating and/or cooling unit. The term "building" refers to a house, building or other enclosed dwelling. The term "living area" refers to a room or group of rooms in the house, building or other dwelling that is designed to be inhabited. The phrase "an area outside of the living areas" refers to an area between the living areas and the ground, additional floor or external portion of the building such as a crawl space, utility space or attic. The term "partition" refers to a wall, ceiling, floor or other portion of the building that encloses the living areas.

Figure 1:
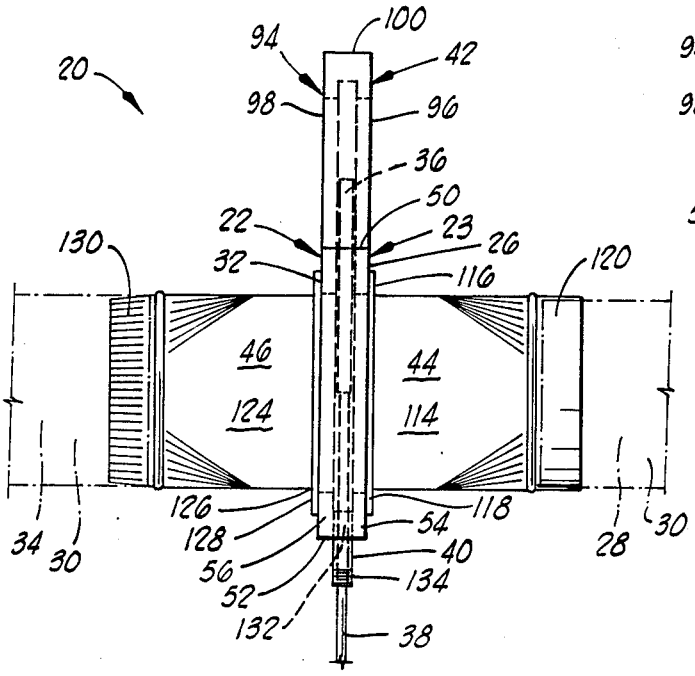
FIG. 1 is a side elevational view of the apparatus of the present invention.
Figure 2:
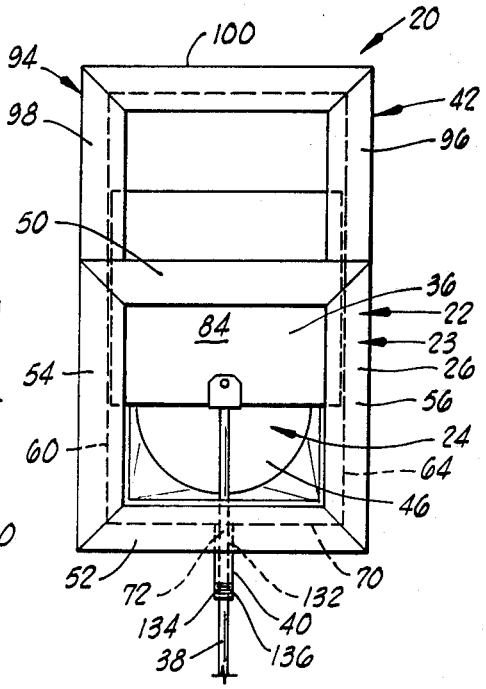
FIG. 2 is a front elevational view of the apparatus of the present invention without the first connecting means attached thereto.

Referring now to the drawings, and particularly to FIGS. 1–13, the air control apparatus of the present invention is illustrated and generally designated by the numeral 20. As shown in FIGS. 1 and 2, the air control apparatus 20 includes a frame 22 having a border 23 and an air passage 24 defined by the border. The border 23 includes a first surface 26 for attachment to a first portion 28 of the air duct 30 (represented by dotted lines in FIG. 1) in a position such that the first portion of the air duct is in fluid communication with the air passage 24, and an opposite second surface 32 for attachment to a second portion 34 of the air duct in a position such that the second portion of the air duct is in fluid communication with the air passage. An air seal 36 is slidably disposed in the frame 22 between the first surface 26 and the second surface 32 of the border 23. The air seal 36 is movable in and out of the air passage 24 to open and close the air passage and thereby regulate the flow of air therethrough. A handle 38 is removably attached to the air seal 36 and extends away from the frame 22 for allowing the air passage 24 to be manually opened and closed from within the living area of the building (not shown). A handle guide tube 40 is attached to the frame 22 for receiving the handle 38 and guiding the handle away from the frame. Support means 42 for supporting the air seal 36 when the air seal is moved out of the air passage 24 are attached to the frame 22. First connecting means 44 for connecting the first surface 26 of the border 23 to the first portion 28 of the air duct are attached to the first surface of the border. Second connecting means 46 for connecting the second surface 32 of the border 23 to the second portion 34 of the duct 30 are attached to the second surface of the border.

Figure 13:
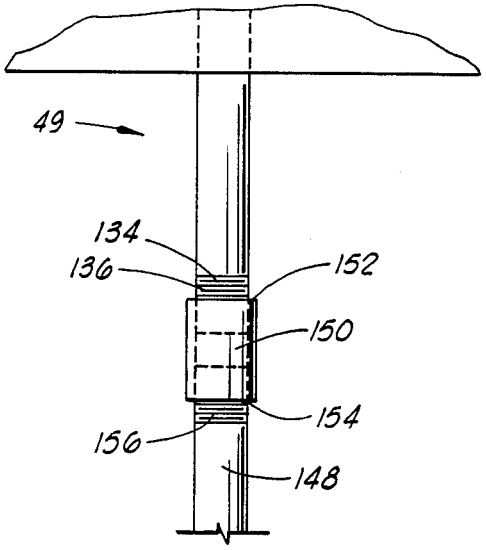
FIG. 13 is a partial front elevational view of the handle guide tube extension means of the apparatus of the present invention.
Figure 11:
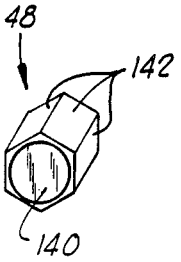
FIG. 11 is a front perspective view of the cap of the apparatus of the present invention.
Figure 12:
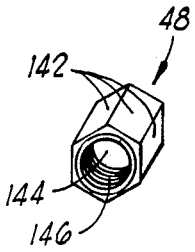
FIG. 12 is a rear perspective view of the cap of the apparatus of the present invention.

As shown in FIGS. 11–13, the air control apparatus 20 also includes a cap 48 and handle guide tube extension means 49. The cap 48 functions to seal the handle guide tube 40 when the handle 38 does not extend therethrough. The handle guide tube extension means 49 function to extend the length of the handle guide tube 40.

Figure 4:
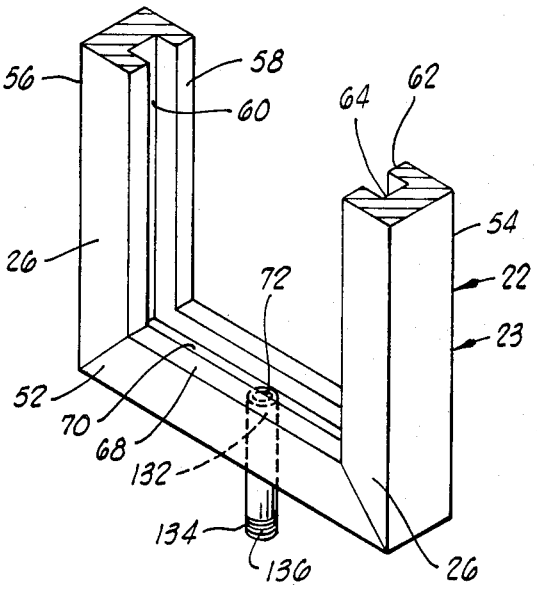
FIG. 4 is a partial perspective view of the bottom portion and side portions of the border of the frame of the apparatus of the present invention.

As best shown in FIGS. 2 and 4, the border 23 of the frame 22 includes a top portion 50, a bottom portion 52 and two opposing side portions 54 and 56. The air passage 24 defined by the border 23 is of a size sufficient to surround the first portion 28 and second portion 34 of the air duct 30. The front surfaces of the top portion 50, bottom portion 52 and side portions 54 and 56 form the first surface 26 of the border 23, while the rear surfaces of the top portion 50, bottom portion 52 and side portions 54 and 56 from the second surface 32 of the border 23.

Figure 5:
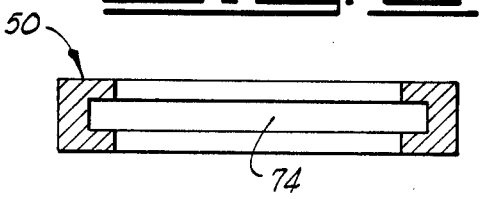
FIG. 5 is a top view of the top portion of the border of the frame of the apparatus of the present invention.

The side portion 54 of the border 23 has an inner end surface 58 that has a first groove 60 longitudinally disposed therein. Similarly, the side portion 56 has an inner end surface 62 that has a first groove 64 longitudinally disposed therein. The inner end surface 58 and first groove 60 of the side portion 54 face the inner end surface 62 and first groove 64 of the side portion 56. The bottom portion 52 of the border 23 includes a top surface 68 facing the top portion 50 of the border. The top surface 68 has a second groove 70 longitudinally disposed therein for receiving the bottom of the air seal when the air passage 24 is completely closed therewith. The bottom portion 52 also has an opening 72 perpendicularly extending therethrough for receiving the handle 38. As best shown in FIG. 5, the top portion 50 of the border 23 has a slot 74 longitudinally disposed therein through which the air seal 36 can extend when being moved in and out of the air passage 24.

Figure 3:
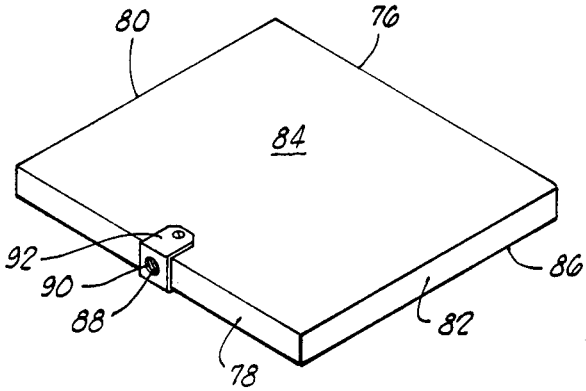
FIG. 3 is a perspective view of the air seal of the apparatus of the present invention.

As best shown in FIG. 3, the air seal 36 is a panel that includes a top 76, a bottom 78, two opposing sides 80 and 82 connecting the top to the bottom, a front surface 84 and a rear surface 86. The side 80 of the air seal 36 is slidably positioned in the first groove 60 disposed in the inner end surface 58 of the side portion 54 while the side 82 of the air seal 36 is slidably positioned in the first groove 64 of the inner end surface 62 of the side portion 56. The bottom 78 of the air seal 36 includes an opening 88 having a plurality of threads 90 disposed therein for threadingly receiving the handle 38. A reinforcing plate 92 is attached to the front surface 84, rear surface 86 and around the opening 88 in the bottom 78 of the air seal 36 to reinforce the structure of the air seal surrounding the opening.

The air seal 36 can be moved from a position completely or almost completely out of the air passage 24 to an infinite number of positions in the air passage including a position in which the air passage is completely closed. When the air seal 36 is completely drawn across the air passage 24, the bottom 78 of the air seal extends into the second groove 70 of the top surface 68 of the bottom 52 of the border 23.

Figure 6:
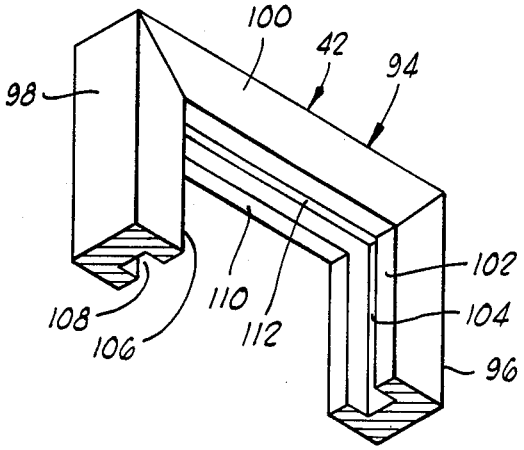
FIG. 6 is a partial perspective view of the side portions and top portion of the upper frame of the apparatus of the present invention.

The support means 42 comprise an upper frame 94 that includes two opposing side portions 96 and 98 and a top portion 100 connecting the side portions 96 and 98 together. As best shown in FIG. 6, the side portion 96 includes an inner end surface 102 that has a third groove 104 longitudinally disposed therein. Similarly, the side portion 98 includes an inner end surface 106 that has a third groove 108 longitudinally disposed therein. The inner end surface 102 and third groove 104 of the side portion 96 face the inner end surface 106 and third groove 108 of the side portion 98. The side portions 96 and 98 are attached to the top portion 50 of the border 23 such that the third grooves 104 and 108 thereof are in alignment with the first grooves 60 and 64, respectively, of the side portions 54 and 56 of the border 23 whereby the sides 80 and 82 of the air seal 36 are received by the third grooves 104 and 108, respectively, when the air seal 36 is moved out of the air passage 24. The top portion 100 of the upper frame 94 has a bottom surface 110 facing the top portion 50 of the border 23 that has a fourth groove 112 longitudinally disposed therein for receiving the top 76 of the air seal 36 when the air seal is moved to a position completely or almost completely out of the air passage 24. The top portion 100 of the upper frame 94 is removable from the side portions 96 and 98 thereof.

Figure 7:
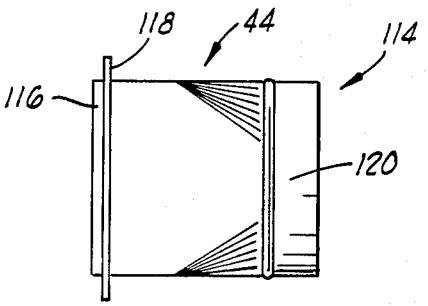
FIG. 7 is a side elevational view of the first connecting means of the apparatus of the present invention.
Figure 9:
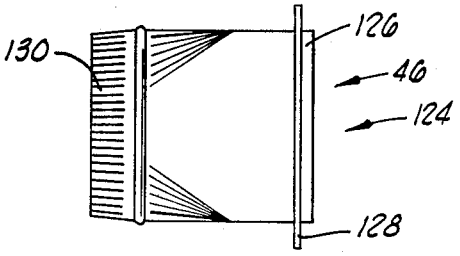
FIG. 9 is a side elevational view of the second connecting means of the apparatus of the present invention.
Figure 8:
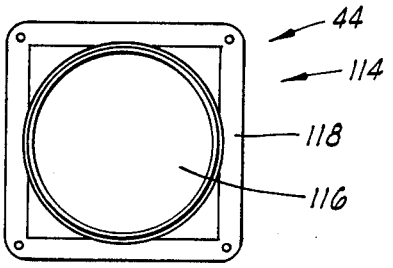
FIG. 8 is a rear elevational view of the first connecting means of the apparatus of the present invention.
Figure 10:
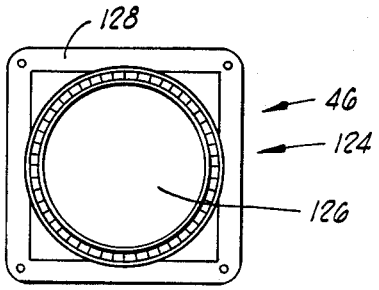
FIG. 10 is a rear elevational view of the second connecting means of the apparatus of the present invention.

As shown in FIGS. 1, 7 and 8, the first connecting means 44 for connecting the first surface 26 of the border 23 to a first portion 28 of the air duct 30 comprises a first air transfer conduit 114 that includes a first end 116 extending into the air passage 24, an outwardly extending flange portion 118 spaced from the first end 116 and attached to the first surface 26 of the border 23 and a second end 120 for attachment to the first portion 28 of the air duct 30. Similarly, as shown in FIGS. 1, 9 and 10, the second connecting means 46 for connecting the second surface 32 of the border 23 to the second portion 34 of the air duct 30 comprise a second air transfer conduit 124 that includes a first end 126 extending into the air passage 24, an outwardly extending flange portion 128 spaced from the first end 126 and attached to the second surface 32 of the border 23 and a second end 130 for attachment to the second portion 34 of the air duct 30.

The first end 116 of the first air transfer conduit 114 and the first end 126 of the second air transfer conduit 124 have a cross-sectional configurations approximately the same as the cross-sectional configurations of the border 23 and air passage 24. The second end 120 of the first air transfer conduit 114 and the second end 130 of the second air transfer conduit 124 have cross-sectional configurations approximately the same as the cross-sectional configurations of the first portion 28 and second portion 34 of the air duct 30. The second end 120 of the first air transfer conduit 114 is slightly larger than the first portion 28 of the air duct 30 so that the first portion of the air duct can be slidably inserted therein. An annular clamp can be used to tighten the second end 120 of the first air transfer conduit 114 onto the first portion 28 of the air duct 30. The second end 130 of the second air transfer conduit 124 is slightly smaller than the second portion 34 of the air duct 30 so that it can be slidably inserted into the second portion of the air duct. An annular clamp can be used to tighten the second portion 34 of the air duct 30 onto the second end 130 of the second air transfer conduit 124.

The handle 38 is a rod extending from the air seal 36 through the opening 72 in the bottom portion 52 of the border 23 and through the handle guide tube 40 away from the frame 22. As best shown in FIGS. 1 and 2, the handle 38 includes a first end 130 that is threadingly inserted into the opening 88 in the bottom 78 of the air seal 36. By being threadingly attached to the air seal 36, the handle 38 can be easily attached to and removed from the air control apparatus 20 as desired.

The handle guide tube 40 is a hollow tube having a first end 132 attached to the bottom portion 52 of the border 23 and a second end 134 spaced from the frame 22. The second end 134 has a plurality of threads 136 disposed thereon. The handle guide tube 40 functions to guide the handle 38 from the frame 22 into a living area of the building being serviced. When the apparatus 20 is installed, the second end 134 of the handle guide tube 40 extends through a partition enclosing the living area into the living area.

As shown in FIGS. 11 and 12, the cap 48 is a polygonal nut having a front surface 140, a plurality of outer flat surfaces 142 and an inner opening 144. The inner opening 144 has a plurality of threads 146 disposed therein. When used, the cap 48 is threadingly attached to the second end 134 of the handle guide tube 40. It can be easily attached to and removed from the handle guide tube 40 as desired. Although the cap 48 can be attached to and removed from the second end 134 of the handle guide tube 40 by hand in most situations, the outer flat surfaces 142 allow the cap to be easily removed with a tool such as a pair of pliers or a crescent wrench if necessary.

As shown in FIG. 13, the handle guide tube extension means 49 includes a tube extension member 148 and a tube coupling member 150. The tube coupling member has a first end 152 that can be threadingly attached to the second end 134 of the handle guide tube 40 and a second end 154 that can be threadingly attached to the tube extension member 148. The tube extension member 148 has a first end 156 attached to the second end 154 of the tube coupling member 150 and a second end 158 spaced therefrom (shown in FIGS. 15 and 16). Like the second end 134 of the handle guide tube 40, the second end 158 of the tube extension member 148 has a plurality of threads 160 disposed thereon so that the cap 48 or additional tube extension members can be attached thereto.

The air control apparatus 20, including the border 23, air passage 24, air seal 36, handle 38, handle guide tube 40, support means 42, first connecting means 44 and second connecting means 46, can be made in a variety of sizes and shapes. The particular sizes and shapes of the apparatus and parts thereof can vary according to the size, shape and location of the air ducts of the air conditioning system. In almost all air conditioning systems, the air ducts are annular in shape, i.e., the air ducts have a circular cross-sectional configuration. The diameters of the air ducts vary somewhat from system to system. In a preferred embodiment of the air control apparatus 20, the cross-sectional configurations of the border 23, air passage 24, air seal 36, first end 116 of the first air transfer conduit 114 and first end 126 of the second air transfer conduit 124 are approximately square in shape. The cross-sectional configurations of the second end 120 of the first air transfer conduit 114 and the second end 130 of the second air transfer conduit 124 are approximately circular in shape. The top portion 50, bottom portion 52 and side portions 54 and 56 of the border 23 and the side portions 96 and 98 and top portion of the upper frame 94 are all approximately $1\frac{1}{2}$ inches wide and $1\frac{1}{2}$ inches thick. The first groove 60, first groove 64, second groove 70, third groove 104, third groove 108, fourth groove 112 and slot 74 are all approximately 9/16ths of an inch wide. The first grooves 60 and 64, second groove 70, third grooves 104 and 108 and fourth groove 112 are all approximately $\frac{1}{4}$ of an inch deep. Of course, as shown in FIG. 5, the slot 74 extends completely through the top portion 50. The opening 88 in the bottom 78 of the air seal 36 is approximately $\frac{1}{4}$ of an inch in diameter. The air seal 36 itself is approximately $\frac{1}{2}$ of an inch thick.

The air control apparatus 20 and various parts thereof can be made out of a variety of materials. The air seal 36 should be formed out of heat/fire resistant material. Preferably, the border 23 and air seal 36 are predominately made of plastic.

Figure 14:
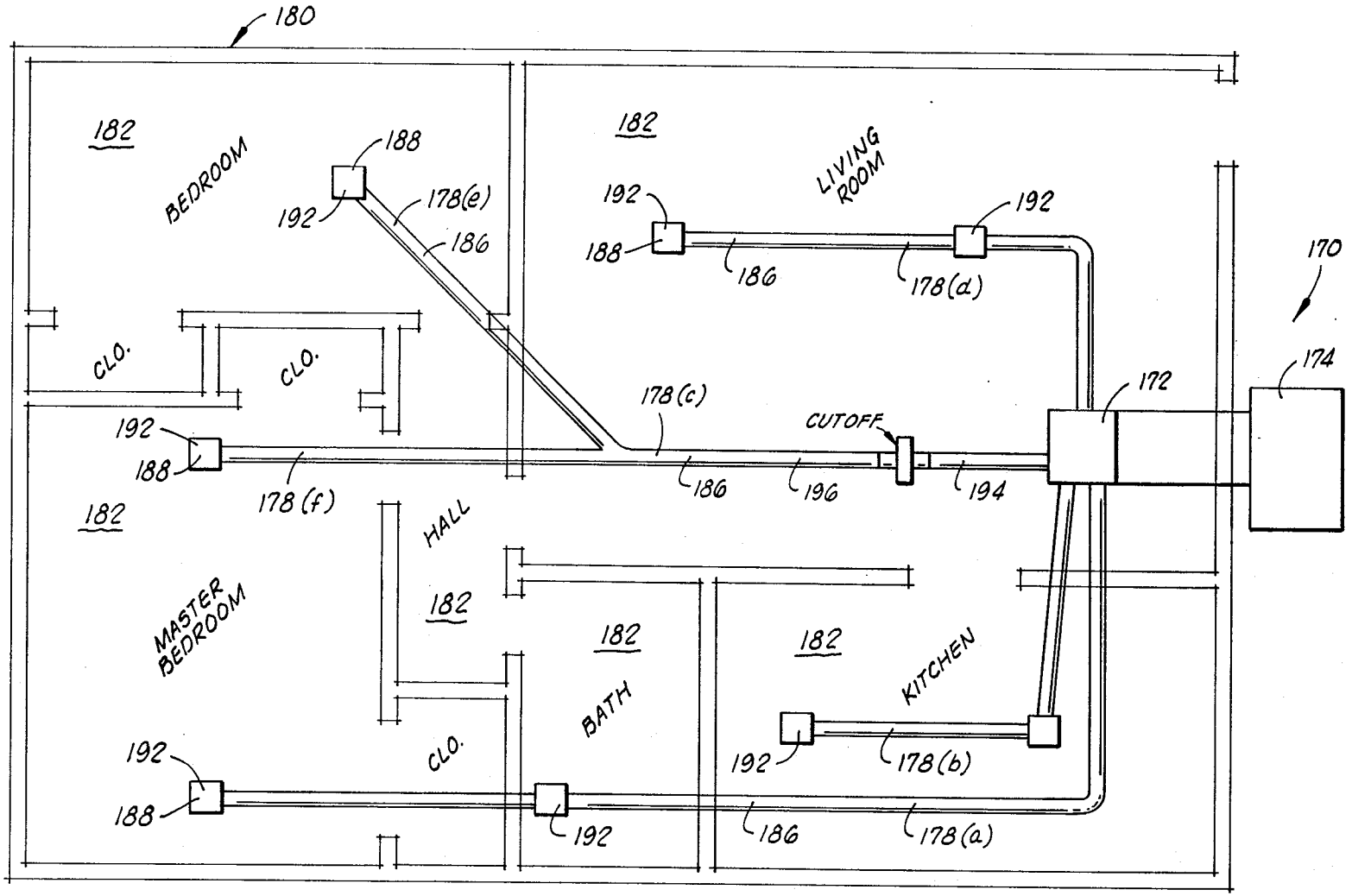
FIG. 14 is a schematic view illustrating the apparatus of the present invention employed in a forced air central air conditioning system.
Figure 15:
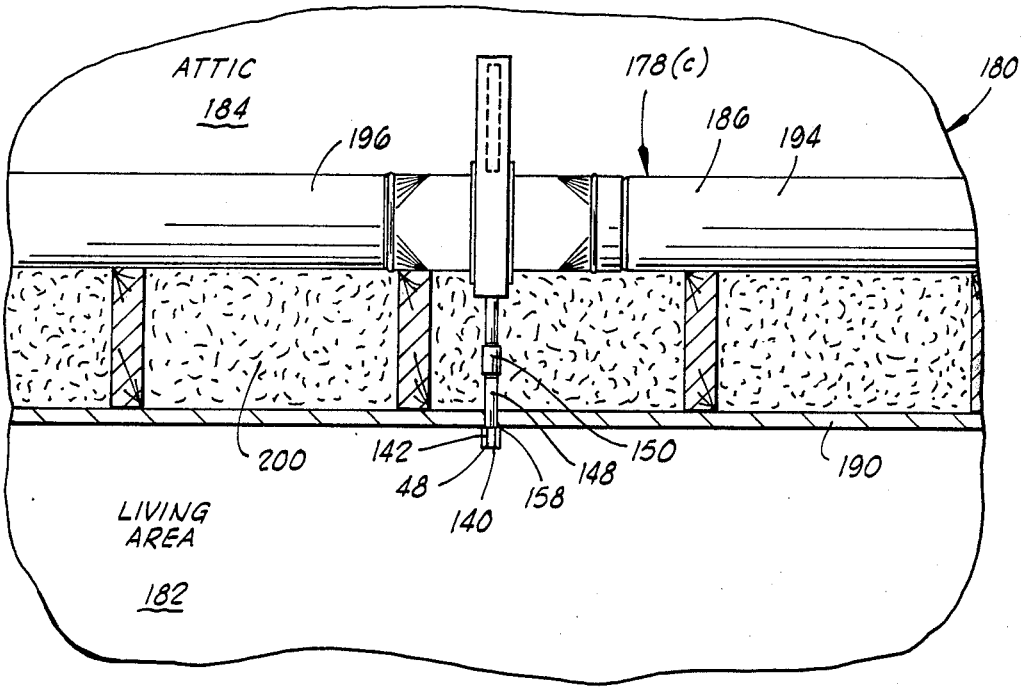
FIG. 15 is a partial sectional view illustrating the apparatus of the present invention employed in a forced air central air conditioning system.
Figure 16:
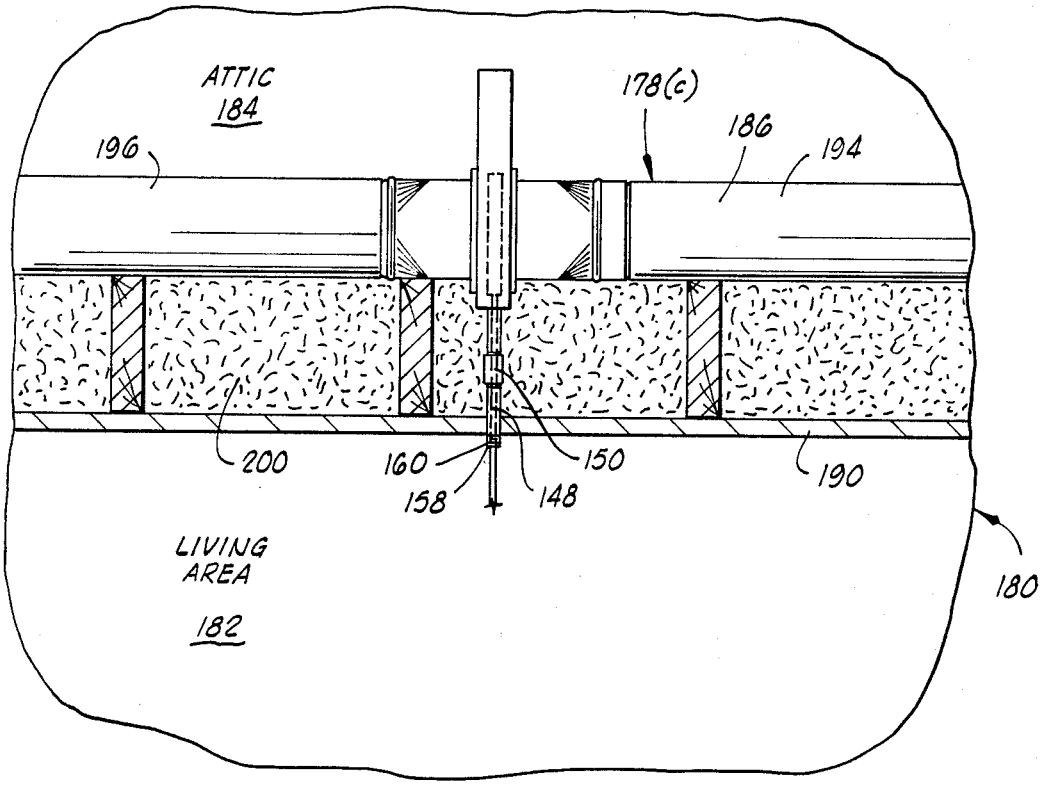
FIG. 16 is a different partial sectional view of the apparatus of the present invention employed in a forced air central air conditioning system.

Referring now to FIGS. 14–16, the forced air central air conditioning system of the present invention is illustrated and generally designated by the numeral 170. The system 170 includes an air conditioning unit 172, a heat exchanger 174, a plurality of ducts **178(*a*)–178(*f*) and the air control apparatus 20. As illustrated, the system is installed in a residential house 180 to condition the air in various living areas 182 thereof. The air conditioning unit 172 is installed in a closet in the house while the heat exchanger 174 is installed outside of the house. The ducts 178(*a*)–178(*f*) extend from the unit 172 through an attic 184 and into the various living areas 182**.

The air conditioning unit 172 functions to condition the air while ducts **178(*a*)–178(*f*) function to conduct the conditioned air from the unit to the living areas 182. Each of the ducts 178(*a*)–178(*f*) has a main section 186 extending through the attic 184 and a tail section 188 extending from the main section through a ceiling 190 and into the living areas. The tail section 188 of each of the ducts 178(*a*)–178(*f*) has an air vent 192** disposed on the end thereof.

As shown in FIG. 14, the air control apparatus 20 is positioned to regulate the flow of air through the duct **178(*c*) and hence to a portion of the master bedroom and a secondary bedroom of the house. The apparatus 20 is positioned between a first portion 194 of the main section 186 of the duct 178(*c*) and a second portion 196 of the main section 186 of the duct 178(*c*). As shown in FIGS. 15 and 16, the handle guide tube 40 of the air control apparatus 20 extends from the bottom portion 52 of the border 23 of the frame 22 through attic insulation 200 and the ceiling 190 into a living area 182. For aesthetic reasons, the second end 134 of the handle guide tube 40 should only slightly extend from the ceiling or other partition into the living area. As shown by FIG. 16, the handle 38 extends from the air seal 36 through the opening 72 in the bottom portion 52 of the border 23 and through the handle guide tube 40 (including handle guide tube extension means 49) into the living area 182. As shown in FIG. 15, the handle 38 is removed from the air control apparatus 20 and the cap 48 is inserted on the second end 134 of the handle guide tube 40 (as extended by handle guide tube extension means 49**).

In operation, the air seal 36 is moved to the desired position in the air passage 24. As shown in FIG. 16, the handle 38 is inserted through the handle guide tube 40 and opening 72 of the bottom portion 52 of the border 23 into the opening 88 in the bottom 78 of the air seal 36 and is threadedly engaged therewith. The handle 38 is then pushed up or pulled down relative to the air control apparatus 20 to move the air seal 36 to the desired position. As shown in FIG. 16, the air seal 36 is positioned in the air passage 24 to completely block the flow of air therethrough. As shown in FIG. 15, the air seal is positioned completely in the upper frame 94 to allow unrestricted flow of air through the air passage 24. Alternatively, the air seal can be adjusted to a position in the air passage 24 that results in partial restriction of the air flow therethrough. Inasmuch as the air seal can be adjusted to an infinite number of positions in the air passage 24, the amount of air that is allowed to flow can be very accurately controlled.

As shown in FIG. 15, once the air seal is moved to the desired position, the handle 38 is unscrewed from the opening 88 in the bottom 78 of the air seal 36 and completely removed from the air control apparatus 20. The cap 48 is inserted onto the second end 134 of the handle guide tube 40 (as extended by handle guide tube extension means 49) to seal the handle guide tube and to improve the aesthetic appearance of the ceiling.

If desired, a plurality of air control apparatus 20 can be employed in a single house or building. When a plurality of air control apparatus 20 are employed, one handle 38 can be used to operate all of the apparatus.

The following example is provided to illustrate the effectiveness of the air control apparatus of the present invention in improving the efficiency of a forced air central air conditioning system.

EXAMPLE

The air control apparatus of the present invention was installed in a forced air central air conditioning system used to service a two bedroom residential house. The air conditioning system and house were identical to the air conditioning system and house schematically illustrated in FIGS. 14–16 of the drawings. As illustrated, the air control apparatus was positioned between a first portion 194 of the main section 186 of the duct 178(*c*) and the second portion 196 of the main section 186 of the duct 178(*c*).

The air control apparatus was installed in the system on July 28, 1988. The air seal 36 was positioned in the air passage 24 to completely block the flow of air therethrough and thereby cut off the flow of air into the secondary bedroom and one portion of the master bedroom. The system was then operated in a normal manner through Oct. 28, 1988.

To determine the effectiveness of the apparatus in saving energy, the electricity bills for the overall electricity used by the house for the months of August, September and October of 1988 were compared to the electricity bills for the overall electricity used by the house for the months of August, September and October of 1987, the exact time period one year earlier. The results of the comparison are shown in Table I below:

TABLE I

| Savings in Electricity | |
|---|---|
| Electricity Bill (Month) | Amount ($$) |
| August, 1988* | $123.12 |
| September, 1988* | 76.07 |
| October, 1988* | 89.73 |
| Total | $288.92 |
| August, 1987** | $158.48 |
| September, 1987** | 138.73 |
| October, 1987** | 104.03 |
| Total | $401.24 |

*System included the inventive air control apparatus.
**System did not include the inventive air control apparatus.

The results show that the apparatus of the present invention reduced the electricity bills for the three month test period by a total of $112.32 or 28%. Thus, the air control apparatus of the present invention effectively improves the efficiency of forced air central air conditioning systems.

The apparatus of this invention is well adapted, therefore, to carry out the objects and attain the ends and advantages mentioned as well as those inherent therein. While numerous changes in the construction and arrangement of the parts will suggest themselves to those skilled in the art, such changes are encompassed within the spirit of this invention as defined in the appended claims.

What is claimed is:

1. A forced air central air conditioning system for conditioning the air in a living area of a building, comprising:

an air conditioning unit for conditioning said air;

a duct for conducting said air from said air conditioning unit to said living area, said duct having a main section extending through an area outside of said living area and a tail section extending from said main section through a partition enclosing said living area into said living area; and an air control apparatus positioned between a first portion of said main section of said duct and a second portion of said main section of said duct, said air control apparatus comprising:

a frame having a border and an air passage defined by said border, said border having a first surface attached to said first portion of said main section of said duct in a position such that said first portion of said main section of said duct is in fluid communication with said air passage and a second surface attached to said second portion of said main section of said duct in a position such that said second portion of said main section of said duct is in fluid communication with said air passage whereby air can flow from said first portion of said main section of said duct through said air passage into said second portion of said main section of said duct;

an air seal slidably disposed in said frame between said first and second surfaces of said border, said air seal being movable in and out of said air passage to open and close said air passage and thereby regulate the flow of air therethrough; and a handle removably attached to said air seal and extending away from said frame through a partition enclosing said living area into said living area for allowing said air passage to be manually opened and closed from within said living area.

2. The apparatus of claim 1 wherein:

said border of said frame of said air control apparatus comprises a top portion, a bottom portion and two opposing side portions connecting said top portion to said bottom portion, said side portions having inner end surfaces with the inner end surface of one side portion facing the inner end surface of the other side portion and each inner end surface having a first groove longitudinally disposed therein; and said air seal of said air control apparatus comprises a panel having a top, a bottom and two opposing sides connecting said top to said bottom, each of said opposing sides being slidably positioned in one of said first grooves.

3. The apparatus of claim 2 wherein said top portion of said border of said frame of said air control apparatus has a slot longitudinally disposed therein through which said air seal can extend when being moved in and out of said air passage.

4. The apparatus of claim 2 wherein said bottom portion of said border of said frame of said air control apparatus has a top surface facing said top portion of said border, said top surface having a second groove longitudinally disposed therein for receiving said bottom of said air seal.

5. The apparatus of claim 2 wherein said air control apparatus further comprises support means attached to said frame for supporting said air seal when said air seal is moved out of said air passage.

6. The apparatus of claim 5 wherein said support means of said air control apparatus comprises an upper frame having two opposing side portions and a top portion connecting said side portions together, said side portions having inner end surfaces with the inner end surface of one side portion facing the inner end surface of the other side portion and each inner end surface having a third groove longitudinally disposed therein, said side portions being attached to said border of said frame such that said third grooves are in alignment with said first grooves of said side portions of said border whereby said sides of said air seal are received by said third grooves when said air seal is moved out of said air passage.

7. The apparatus of claim 6 wherein said top portion of said upper frame of said air control apparatus has a bottom surface facing said top portion of said border, said bottom surface having a fourth groove longitudinally disposed therein for receiving said top of said air seal.

8. The apparatus of claim 2 wherein said bottom portion of said border of said frame of said air control apparatus has an opening perpendicularly extending therethrough and said handle comprises a rod extending from said air seal through said opening.

9. The apparatus of claim 1 wherein said air control apparatus further comprises a handle guide tube for receiving said handle and guiding said handle from said frame through said partition into said living area, said handle guide tube having a first end attached to said frame and a second end spaced therefrom.

10. The apparatus of claim 9 further comprising a cap for sealing said second end of said handle guide tube when said handle does not extend therethrough.

11. The apparatus of claim 1 wherein said air control apparatus further comprises first connecting means attached to said first surface of said border for connecting said first surface of said border to a first portion of said main section of said duct and second connecting means attached to said second surface of said border for connecting said second surface of said border to said second portion of said main section of said duct.

12. The apparatus of claim 11 wherein said first connecting means and said second connecting means of said air control apparatus both comprise air transfer conduits, said air transfer conduits each comprising:

a first end extending into said air passage and having a cross-sectional configuration approximately the same as the cross-sectional configuration of said air passage;

an outwardly extending flange portion spaced from said first end and attached to said corresponding first or second surface of said border; and a second end attached to said corresponding first or second portion of said main section of said duct, said second end having a cross-sectional configuration approximately the same as the crosssectional configurations of said first and second portions of said main section of said duct.

13. In a forced air central air conditioning system having an air conditioning unit for conditioning air and a duct for conducting conditioned air from the air conditioning unit to a living area of a building wherein the duct has a main section extending through an area outside of the living area and a tail section extending from the main section through a partition enclosing the living area into the living area, the improvement comprising an air control apparatus positioned between a first portion of the main section of the duct and a second portion of the main section of the duct, said air control apparatus comprising:

a frame having a border and an air passage defined by said border, said border having a first surface attached to said first portion of said main section of said duct in a position such that said first portion of said main section of said duct is in fluid communication with said air passage and a second surface attached to said second portion of said main section of said duct in a position such that said second portion of said main section of said duct is in fluid communication with said air passage whereby air can flow from said first portion of said main section of said duct through said air passage into said second portion of said main section of said duct;

an air seal slidably disposed in said frame between said first and second surfaces of said border, said air seal being movable in and out of said air passage to open and close said air passage and thereby regulate the flow of air therethrough; and a handle removably attached to said air seal and extending away from said frame through a partition enclosing said living area into said living area for allowing said air passage to be manually opened and closed from within said living area.

14. The apparatus of claim 13 wherein:

said border of said frame of said air control apparatus comprises a top portion, a bottom portion and two opposing side portions connecting said top portion to said bottom portion, said side portions having inner end surfaces with the inner end surface of one side portion facing the inner end surface of the other side portion and each inner end surface having a first groove longitudinally disposed therein; and said air seal of said air control apparatus comprises a panel having a top, a bottom and two opposing sides connecting said top to said bottom, each of said opposing sides being slidably positioned in one of said first grooves.

15. The apparatus of claim 14 wherein said top portion of said border of said frame of said air control apparatus has a slot longitudinally disposed therein through which said air seal can extend when being moved in and out of said air passage.

16. The apparatus of claim 14 wherein said bottom portion of said border of said frame of said air control apparatus has a top surface facing said top portion of said border, said top surface having a second groove longitudinally disposed therein for receiving said bottom of said air seal.

17. The apparatus of claim 14 wherein said air control apparatus further comprises support means attached to said frame for supporting said air seal when said air seal is moved out of said air passage.

18. The apparatus of claim 17 wherein said support means comprises an upper frame having two opposing side portions and a top portion connecting said side portions together, said side portions having inner end surfaces with the inner end surface of one side portion facing the inner end surface of the other side portion and each inner end surface having a third groove longitudinally disposed therein, said side portions being attached to said border of said frame such that said third grooves are in alignment with said first grooves of said side portions of said border whereby said sides of said air seal are received by said third grooves when said air seal is moved out of said air passage.

19. The apparatus of claim 18 wherein said top portion of said upper frame of said air control apparatus has a bottom surface facing said top portion of said border, said bottom surface having a fourth groove longitudinally disposed therein for receiving said top of said air seal.

20. The apparatus of claim 14 wherein said bottom portion of said border of said frame of said air control apparatus has an opening perpendicularly extending therethrough and said handle comprises a rod extending from said air seal through said opening.

21. The apparatus of claim 13 wherein said air control apparatus further comprises a handle guide tube for receiving said handle and guiding said handle from said frame through said partition into said living area, said handle guide tube having a first end attached to said frame and a second end spaced therefrom.

22. The apparatus of claim 21 further comprising a cap for sealing said second end of said handle guide tube when said handle does not extend therethrough.

23. The apparatus of claim 13 wherein said air control apparatus further comprises first connecting means attached to said first surface of said border for connecting said first surface of said border to a first portion of said main section of said duct and second connecting means attached to said second surface of said border for connecting said second surface of said border to said second portion of said main section of said duct.

24. The apparatus of claim 23 wherein said first connecting means and said second connecting means of said air control apparatus both comprise air transfer conduits, said air transfer conduits each comprising:

a first end extending into said air passage and having a cross-sectional configuration approximately the same as the cross-sectional configuration of said air passage;

an outwardly extending flange portion spaced from said first end and attached to said corresponding first or second surface of said border; and a second end attached to said corresponding first or second portion of said main section of said duct, said second end having a cross-sectional configuration approximately the same as the crosssectional configurations of said first and second portions of said main section of said duct.

* * * * *